US005443298A

United States Patent [19]

Finley et al.

[11] Patent Number: 5,443,298

[45] Date of Patent: Aug. 22, 1995

[54] DEVICE FOR TRANSPORTING FLUID FILLED BOTTLES

[75] Inventors: Michael J. Finley, Wilmot, Wis.; Nicholas Fotis, Crystal Lake, Ill.

[73] Assignee: Baxter International Inc., Deerfield, Ill.

[21] Appl. No.: 177,805

[22] Filed: Jan. 6, 1994

Related U.S. Application Data

[63] Continuation of Ser. No. 882,206, May 13, 1992, abandoned.

[51] Int. Cl.[6] ..... B65D 71/00

[52] U.S. Cl. ..... 294/87.2; 294/159; 206/148; 206/159

[58] Field of Search ..... 294/32, 34, 87.2, 87.26, 294/87.28, 159; 206/148, 149, 151, 152, 153, 158, 159, 160, 199, 427, 428

[56] References Cited

U.S. PATENT DOCUMENTS

| | | | |
|---|---|---|---|
| 2,454,178 | 11/1948 | Howell | 294/87.26 |
| 2,964,348 | 12/1960 | Ingham | 294/87.28 |
| 3,144,269 | 8/1964 | Orr | 294/87.28 |
| 3,285,410 | 11/1966 | Brunsing | 294/87.28 X |
| 3,804,309 | 4/1974 | Kwak | 294/159 |
| 3,910,622 | 10/1975 | Nies | 294/87.26 X |
| 4,401,212 | 8/1983 | Fischer | 294/87.2 X |
| 4,623,185 | 11/1986 | Thomas | 294/87.28 |
| 5,096,246 | 3/1992 | Cnare | 294/159 X |

FOREIGN PATENT DOCUMENTS

| | | | |
|---|---|---|---|
| 8192 | of 1900 | United Kingdom | 294/159 |
| 316609 | 12/1971 | U.S.S.R. | 294/87.26 |

OTHER PUBLICATIONS

Photocopy of a physical sample of a bottle carrier sold by Abbott Laboratories No Date.

*Primary Examiner*—Dean J. Kramer

*Attorney, Agent, or Firm*—Amy L. H. Rockwell; Paul E. Schaafsma; Paul C. Flattery

[57] ABSTRACT

A bottle carrier including composite openings that include a round oversized opening to permit vertical entry of a bottle neck having a supporting flange therethrough, and an adjoining keyed opening wherein the bottle can laterally be slid into the keyed opening to be held therein. The supporting flange, being larger than the keyed opening, supports the bottle thereon. Each keyed opening is provided with retaining members which are arranged on either side of the keyed opening and which resiliently grip a backside of a diameter of the bottle neck or flange after the bottle neck is laterally slid into the keyed opening. Laterally arranged ribs are provided at each opening which provide the frame with sufficient thickness to resiliently compress between the flange of the bottle and a transition shoulder of the bottle to tightly grip the bottle into the keyed opening. When a plurality of bottles are arranged and aligned, the last bottle can be locked in place by a tang member which is attached to a perimeter of the last round opening.

7 Claims, 3 Drawing Sheets

DEVICE FOR TRANSPORTING FLUID FILLED BOTTLES

This is a continuation of application Ser. No. 07/882,206, filed on May 13, 1992 now abandoned.

BACKGROUND OF THE INVENTION

The present invention relates generally to devices for transporting containers. More specifically, the present invention relates to devices for transporting fluid filled bottles.

A number of different structures and devices have been proposed for carrying containers and/or bottles. U.S. Pat. No. 2,348,187, U.S. Pat. No. 2,426,756, U.S. Pat. No. 3,442,547, U.S. Pat. No. 3,815,947, U.S. Pat. No. 4,093,295, U.S. Pat. No. 4,159,841, U.S. Pat. No. 4,184,592 and U.S. Pat. No. 4,623,185 disclose various configurations and structures of devices for carrying or retaining structures.

Although a number of devices do provide a means for carrying containers, some disadvantages have been exhibited by some transporting devices. One of the difficulties that has been encountered is with respect to orienting the transporting device on the containers within the packaging used to initially transport the containers. In certain uses, it is desirable to package a plurality of bottles within a carrier device to provide an easy method for removing and carrying the bottles. Some such carrier devices require special modifications to the packaging (e.g., shipping carton used to house the containers), and/or packaging procedure, so as to allow the installation of the device on the bottles.

Another difficulty exhibited by some carriers is insuring that all of the containers are secured in place until the end user deliberately removes the containers. In this regard, the containers located at an end of the carrier are quite often at risk of becoming dislodged during transportation.

SUMMARY OF THE INVENTION

The present invention provides an improved device for transporting multiple bottles. The device is easily secured around the bottles and is particularly adapted for being located on bottles when they are packaged in a shipping carton. Upon unpacking, the device allows multiple bottles to be easily removed and hand carried to a desired location. In this regard, an advantage of the present invention is that the device allows for installation of the carrier onto the bottles without modifications to the packaging (e.g., shipping carton) or packaging procedure.

To this end, the present invention provides a bottle carrier having a frame including a plurality of composite openings therethrough for receiving and securing a neck portion of a bottle. At least one of the composite openings provides a first opening having sufficient size to pass a cap and a flange located on the neck of the bottle, therethrough from a bottom side of the frame. Means are provided for preventing the bottle from exiting the first opening when the bottle is moved from the first opening to a second opening that is also defined by the composite opening.

Preferably, the frame includes at an end thereof a tang member that pivotally abuts a first bottle once the bottle has been shifted to the second opening to prevent the bottle from entering the first opening.

In an embodiment, two retaining members are arranged laterally on either side of the second opening. The retaining members are separated by a distance that is less than the diameter of the flange of the bottle to be passed therethrough. The retaining members are adapted to resiliently spread under force to pass the flange and spring back on a back side of the flange to capture the bottle neck within the second opening.

In an embodiment, at least one rib member, and preferably two rib members, are located on the frame. The rib members are designed to be interfit, along with a thickness of the frame, between the flange and a shoulder portion of a respective bottle. The ribs provide a tight resilient fit between the frame and the bottle.

With respect to each composite opening, the first opening comprises an oversized round opening designed and sized to allow the carrier to be placed over multiple bottles while the bottles are packed in a shipping carton. The first opening opens into a second, keyed opening aligned laterally to the first opening. All keyed openings are oriented on the same lateral side of the first openings to facilitate engagement of all bottles to all keyed openings simultaneously. The keyed openings are entered by the bottle necks as the device is shifted laterally into place, so as to orient the bottles so that the ribs properly press against the bottle shoulders and the retaining members snap past the flange.

As previously noted, a folding tang member is included at one end of a row of bottles. The tang is hinged and initially positioned to allow the carrier to be placed over the bottle necks. After placement of the carrier on the bottles and lateral shifting of the carrier thereafter, the tang is pivoted and snapped into place, preventing the end bottle from laterally retracting and thus dislodging. The tang can be returned to the initial position for carrier removal from the bottles.

The tang is a "living hinge" allowing it to be pivotable. To this end, the folding tang can be pivoted in such a way as to allow the carrier to drop over the bottles without interference, and then be snapped into place to capture the end bottle in the carrier. An inherent problem with some bottle carriers is that the bottle held at one end of the device can become dislodged during transportation. This problem has been inventively solved by using a folding tang member or locking member which is molded into the carrier.

After installation of the carrier on the bottles, the tang is snapped into place against a neck of one of the bottles. The tang is then captured between the under side of the flange or ring on the bottle neck and the upper surface of the shoulder of the bottle. The tang, in this captured position, presses against the bottle and prevents the bottle from becoming dislodged from the retainers during transportation. In particular, the tang prevents the end bottle from sliding laterally from the keyed opening to the round, first, opening where it can become dislodged.

Because the end bottle is captured, the compact packing of the bottles in the carrier prevents lateral movement of the adjacent bottle toward the end bottle. Therefore, none of the bottles aligned therewith can move toward the end bottle and become dislodged from their respective keyed opening.

A method of installing a plurality of bottles into a packing carton and installing a bottle carrier thereon is also provided by the present invention. The method comprises the steps of: providing a plurality of bottles and placing the bottles in a box; providing a carrier having a frame having a plurality of composite openings therethrough for holding a neck portion of a bottle therein, each composite opening having a first opening having sufficient size to pass a flange of the bottle therethrough and a second opening, open into the first opening, having a narrowed construction to cause a portion of the frame to underlie the flange of a bottle held therein; aligning the first openings over the plurality of neck portions of the bottles arranged in the box; vertically moving the frame downward over the neck portions of the bottles until the flanges are arranged on a top side of the frame; and laterally shifting the frame in a second direction moving the second openings into position under the flanges.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
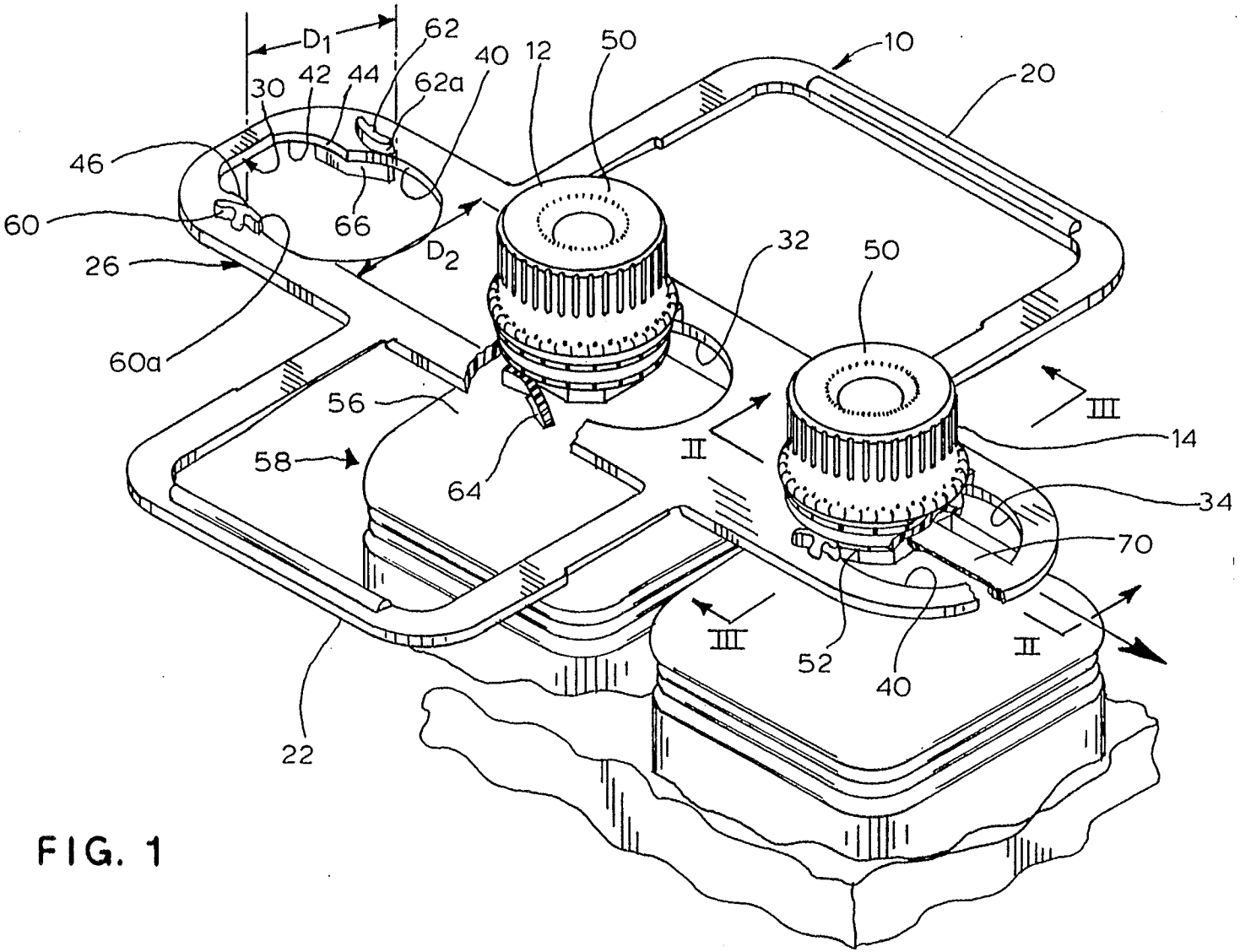
FIG. 1 is a perspective view of an embodiment of the bottle carrier of the present invention with portions removed.

The present invention provides an improved bottle carrier and method of using same. Referring now to the figures, and specifically FIG. 1, the bottle carrier 10 is illustrated holding a first bottle 12 and a second bottle 14. In the embodiment illustrated, the carrier 10 can receive three bottles. Of course, the carrier can be constructed to hold other numbers of bottles.

The carrier 10 in the embodiment illustrated is molded from plastic. The carrier 10 comprises a first U-shaped handle 20 and a second U-shaped handle 22 arranged on opposite sides of the carrier 10. The U-shaped handles 20 and 22 form a means for carrying the bottle carrier 10. To this end, the U-shaped handles 20 and 22 can be pivoted upwardly against each other to provide a single handle.

The carrier 10 includes an elongated frame 26 to which the handles 20 and 22 are attached. The frame 26 includes a first bottle socket 30, a second bottle socket 32, and a third bottle socket 34 arranged axially along the length of the frame 26. For clarity of depiction, the first bottle socket 30 has been shown vacant although the carrier 10 would typically hold three bottles therein.

Each bottle socket 30, 32, and 34 includes an oversized circular opening 40 and a keyed opening 42 having lateral straight sides 44 and 46. As discussed below, this allows the bottles 12 and 14 to be received and secured within the carrier 10.

The bottles 12 and 14 typically include a bottle cap 50. The oversized rounded opening 40 is sufficiently large to receive the bottle cap 50 allowing bottles to be received within each bottle socket 30, 32, and 34.

In a preferred embodiment, the bottles have a flange portion 52 arranged on a neck portion 54, and a transition section or shoulder portion 56 which flares out to the general width of a fluid holding compartment 58 of each bottle. As used herein, "flange" can mean any formation on the bottle neck or on the bottle cap or the cap itself which can act as a means for supporting the bottle as described below. The neck portion 54 includes an area which fits relatively tightly and flushly within the keyed opening 42 against the lateral sides 44 and 46 of the keyed opening 42.

Thus, the bottles 12 and 14 are received by the carrier 10 by being inserted into the carrier through the circular opening 40. The frame 26 is then moved laterally causing the bottles to move into the keyed opening 42 with the neck area 54 passing along the lateral sides 44 and 46. In this position the bottle is prevented from rotating due to the straight lateral sides 44 and 46.

Due to the construction of the carrier 10, the flange portion 52 of the bottle will overlie the keyed opening 42 and cannot fit vertically therethrough. Thus, the flange portion 52 vertically supports the bottle in the carrier 10.

Figure 3:
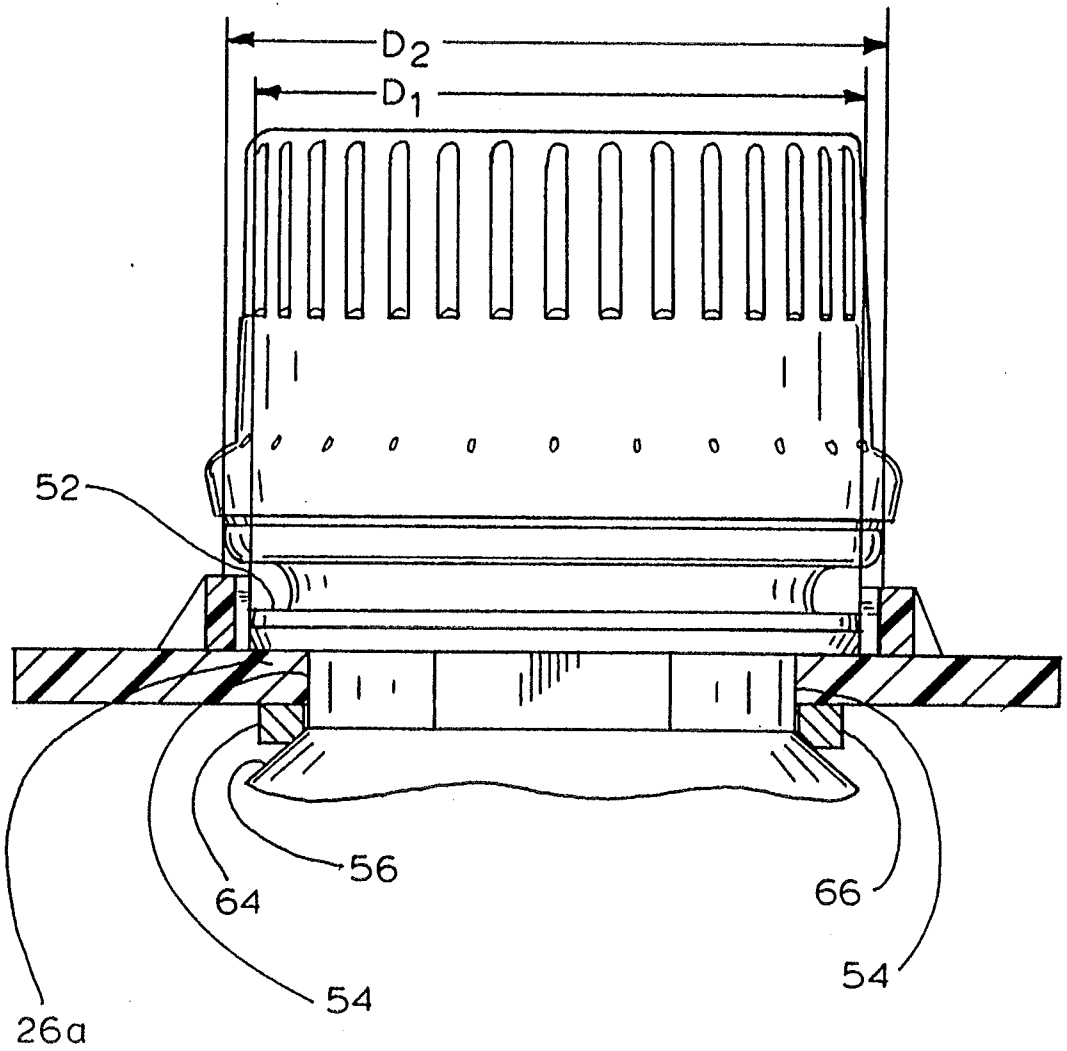
FIG. 3 is a sectional view taken generally through line III—III of FIG. 1.

As illustrated in FIGS. 1 and 3, retainers 60 and 62 extend upwardly from a surface of the frame 26. These retainers 60 and 62 are provided at each bottle socket 30, 32, and 34. The retainers 60 and 62 are sufficiently resilient such that the distance D1 (see FIG. 3) between the retainers 60 and 62 can be smaller than the diameter D2 of the flange portion 52 of the bottle.

The retainers 60 and 62 include an arcuate shape and have lead ends 60*a* and 62*a*. The lead ends 60*a* and 62*a* open up toward the approach of the bottle from the circular opening 40 toward the keyed opening 42 such that the retainers can be forcibly opened or spread by the flange 52 and snap back once the diameter of the flange 52 has passed thereby. This allows the retainers 60 and 62 to resiliently capture the bottle into the keyed opening 42. The retainers 60 and 62 thus prevent bottles 12 and 14 from becoming dislodged from the carrier 10.

On an underside of the frame 26 of the carrier 10, are arranged downwardly extending ribs 64 and 66. The ribs 64 and 66 are laterally arranged on either side of a portion of the circular hole 40 and the key hole 42.

As illustrated in FIG. 3, the ribs 64 and 66 as well as a portion of the frame 26 lying thereover, resiliently and compressibly are received between the flange 52 of the bottle and the shoulder 56. The ribs 64 and 66 have approximately the same arcuate shape as retainers 60 and 62, and allow the bottle 12 to be guided between the ribs in the same way as the retainers 60 and 62. This allows the bottles 12 and 14 to be guided thereon and gradually tightly gripped in a vertical direction. The ribs 64 and 66 are resiliently compressed as the bottles 12 and 14 are progressively received from the circular opening 40 to the keyed opening 42 resulting in a tight vertical hold between the bottle 12 and 14 and the carrier.

FIG. 1 illustrates the second bottle 14 installed into the third socket 34 of the carrier 10. Pursuant to the present invention, a tang 70 is used to hold the bottle 14 into the keyed opening 42.

Figure 2:
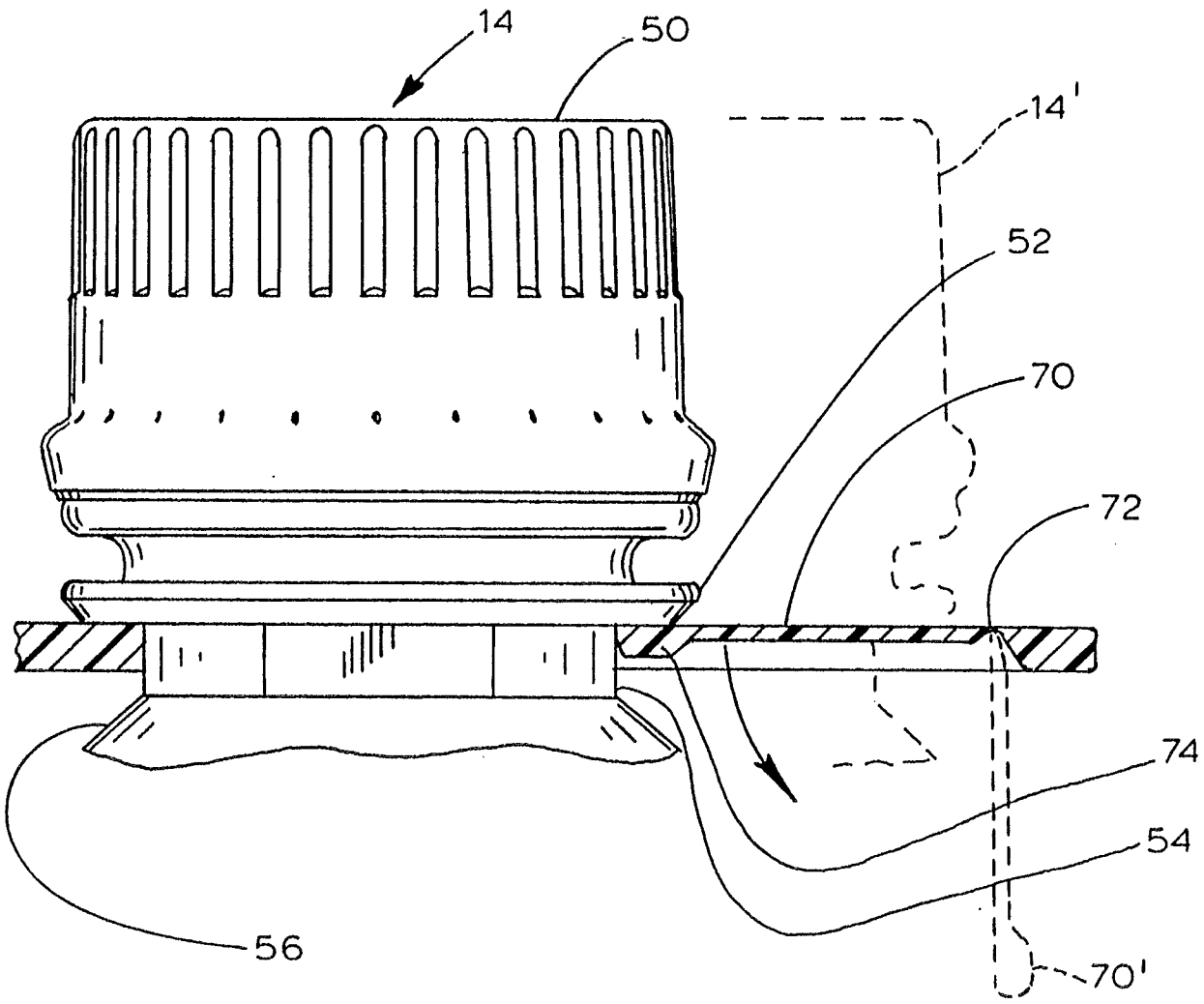
FIG. 2 is a sectional view taken generally through line II—II of FIG. 1.

As illustrated in FIG. 2, the tang 70 is attached to the frame 26 and extends inwardly into the round opening 40 of the bottle socket 34. The tang 70 is connected by a hinge 72, such as a "living hinge." The hinge is created by a thinned section of molded plastic. The tang 70 includes at a distal end thereof a knob portion 74. The tang 70 insures that the end bottle 14 does not become dislodged, i.e., moved into the circular opening 40. Because end bottle 14 is prevented from becoming dislodged, the bottles aligned therebehind are likewise secured in position in the carrier 10.

In operation, the carrier 10 is snapped over the second bottle 14 along with the remaining bottles, each bottle registering with a respective socket such as 30, 32 and 34. As illustrated in FIG. 2, the frame, and thereby the bottle, from the position shown dashed at 14' into the position of the bottle 14 shown in solid line.

The tang 70 is moved upward from the position shown dashed at 70' into its locked position shown in FIG. 2. The tang 70 is thereby captured between the flange 52 and the shoulder 56 of the bottle 14. In this position, the bottle cannot retract its position toward position 14' and is thusly held within the carrier 10.

As illustrated in FIG. 1, because the end bottle 14 is held and the carrier is arranged for the adjacent bottle 12 to be closely abutting the third bottle 14, the bottle 12 cannot move toward the bottle 14 so as to become disengaged from its keyed opening 42. This abutting relationship of the bottles is also present with regard to a bottle fitting into the first socket 30 (not shown in FIG. 1) and along a lateral axis drawn between sockets for a selected number of bottles.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim as our invention:

1. A bottle carrier for transporting a bottle having a neck and including an enlarged diameter section comprising:

a frame defining a composite opening therethrough for receiving the bottle therein, the composite opening including a first open section having sufficient size to allow a portion of the bottle to be received therethrough;

means for securing the bottle within the composite opening including a second open section in communication with the first open section, the second open section having a narrowed width;

a tang member hingedly connected to the frame member such that the tang member is pivotable in relation to the first open section and the tang member being pivotable to project inwardly into the first open section of the composite opening to abut the neck section of the bottle once the bottle has been shifted to a second open section to secure the bottle in the second open section.

2. The bottle carrier of claim 1 wherein the frame includes two vertical retaining members arranged laterally on the top of frame on opposite sides of the composite opening, the retaining members arranged to capture a portion of the bottle when the bottle moves to the second position.

3. The bottle carrier of claim 1 wherein the frame member includes on its bottom rib members extending perpendicularly to the frame member, the rib members arranged laterally on opposite sides of the composite opening, the rib members adapted to be tightly slidable between the enlarged diameter section and a shoulder of the bottle.

4. The bottle carrier of claim 1 further comprising two U-shaped handle members attached on opposite lateral sides of the frame member.

5. A method of installing a plurality of bottles into a packing carton and installing a bottle carrier thereon comprising the steps of:

providing a plurality of bottles having neck portions with flange means and placing the bottles in the packing carton;

providing a carrier having a frame having a plurality of composite openings therethrough for holding the neck portion of a bottle therein, wherein at least one of the openings provides a first opening having sufficient size to pass the flange means of a bottle therethrough and a second opening open into the first opening, the second opening having a narrowed construction to allow portions of the frame to underlie the flange means of the bottle, the plurality of second openings arranged on the lateral side of the plurality of first openings;

aligning the first openings over the plurality of neck portions of the bottles arranged in the packing carton;

vertically moving the frame downward over the neck portions of the bottles until the flange means are arranged on a top side of the frame;

laterally shifting the frame in a second direction, moving the second openings into position under the flange means; and providing means projecting from a surface of the frame for resisting movement of a bottle from the second opening to the first opening after the frame has been laterally shifted in the second direction.

6. The method of claim 5 comprising the further steps of:

providing a pivotable tang member extending in one of the first openings of one of the composite openings;

pivoting the tang member from out of the opening so that the first opening can pass over the neck portion of the bottle; and after the frame has been placed down over the bottle neck portions, pivoting the tang member to engage the neck portion of a bottle held in the one composite opening, preventing said bottle from retraction from the narrowed opening of the composite opening.

7. The method of claim 5 comprising the step of providing handle means for carrying the carrier and removing the bottles from the box by lifting the carrier by using the handle means.

* * * * *